United States Patent [19]

Parkinson et al.

[11] 4,158,115

[45] Jun. 12, 1979

[54] INTERNALLY CONNECTING FLEXIBLE SWITCH

[75] Inventors: Wayne K. Parkinson, Mequon; William R. Kissner, Milwaukee, both of Wis.

[73] Assignee: W. H. Brady Co., Milwaukee, Wis.

[21] Appl. No.: 919,373

[22] Filed: Jun. 26, 1978

[51] Int. Cl.[2] ..... H01H 3/12

[52] U.S. Cl. ..... 200/5 A; 200/159 B; 200/292

[58] Field of Search ..... 200/86 R, 5 R, 5 A, 200/159 B, 292; 339/59 M, 18 R, 18 B, 17 LM, 17 M; 361/398; 340/365 R, 365 A, 365 C, 365 E, 365 L, 365 P, 365 S

[56] References Cited

U.S. PATENT DOCUMENTS

| | | | |
|---|---|---|---|
| 3,680,037 | 7/1972 | Nellis et al. | 339/61 M |
| 3,789,167 | 1/1974 | Seeger, Jr. et al. | 200/5 A |
| 3,879,586 | 4/1975 | DuRocher et al. | 200/5 A |
| 3,959,610 | 5/1976 | Finnegan et al. | 200/5 A |
| 4,028,509 | 6/1977 | Zurcher | 200/5 A |

*Primary Examiner*—J. V. Truhe
*Assistant Examiner*—Morris Ginsburg

[57] ABSTRACT

A flexible touch switch with normally-conductive material inserted in apertures in a spacer layer, for making electrical contact between electrical pathways carried by contact-carrying layers.

9 Claims, 3 Drawing Figures

FIG 1
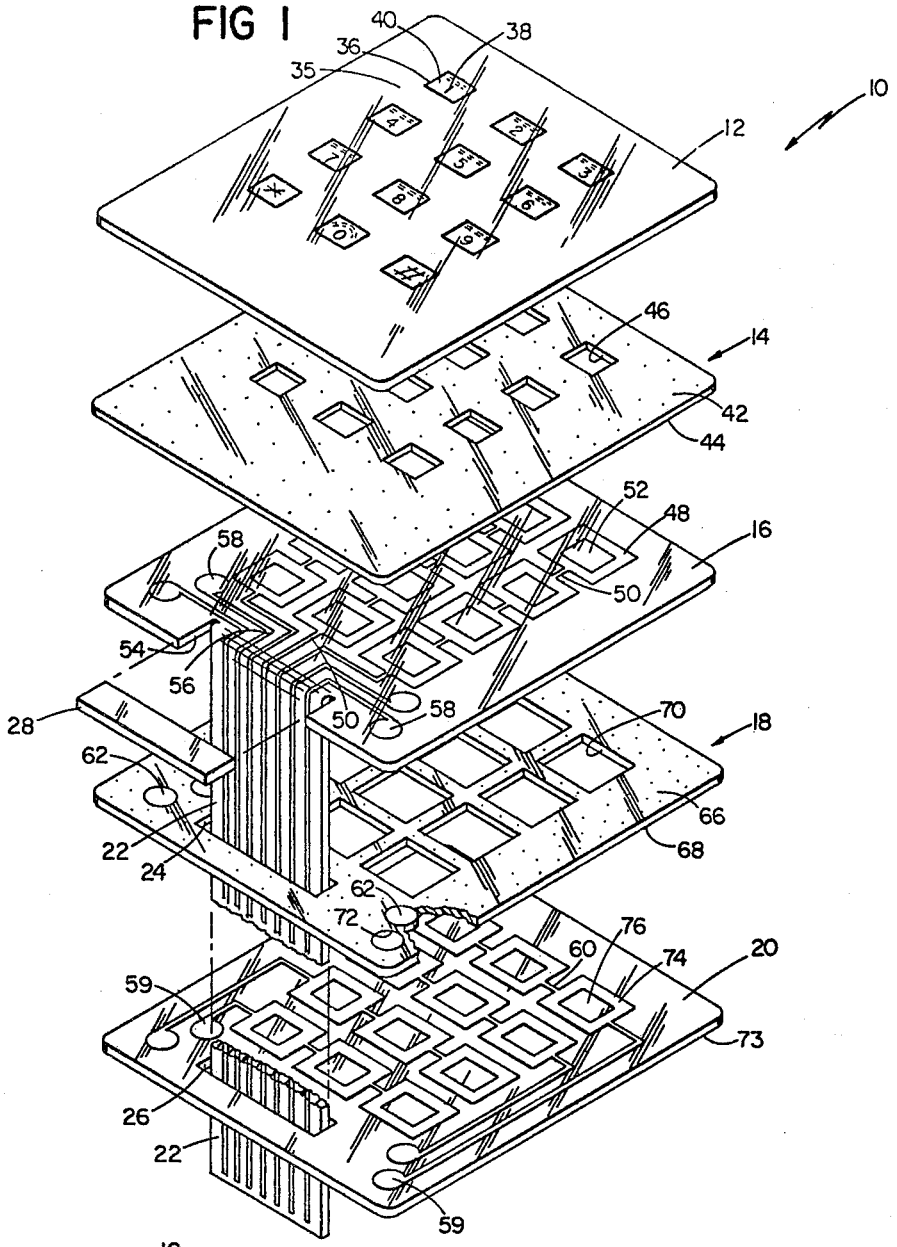
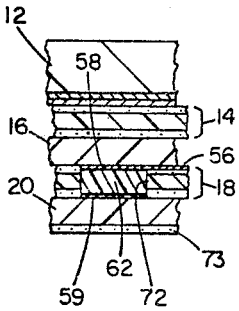
FIG 3
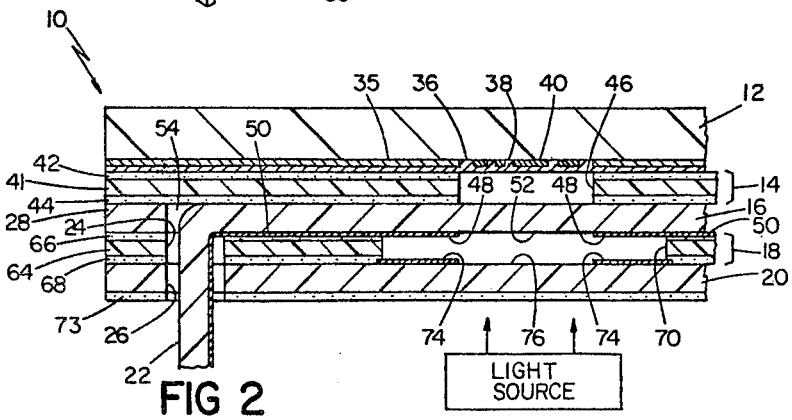
FIG 2

INTERNALLY CONNECTING FLEXIBLE SWITCH

FIELD OF THE INVENTION

This invention relates to flexible touch switches.

BACKGROUND OF THE INVENTION

In making electrical connections between external circuitry and switch contacts on layers of a flexible switch, it is desirable to make internal electrical connections between spaced-apart layers of the switch. In an X-Y matrix flexible switch, for example, wherein there are rows of interconnected contacts on one layer and columns of interconnected contacts on a second spaced-apart layer, it is advantageous to bring out leads only from one of the layers, and make internal connections to the other layer by means contained within the switch. Conventionally, this has been done in several ways, each having its disadvantages.

DuRocher U.S. Pat. No. 3,879,586 shows inserting oversize plugs of elastomeric material with pressure-sensitive conductivity in holes in the spacer layer between two contact-carrying layers, and permanently compressing the plugs between one rigid and one stiff layer, so as to make the plugs conductive. Seeger et al. U.S. Pat. No. 3,789,167 shows using metal pins that protrude through the spacer layer and contact conductive plastic regions beneath the upper layer. Others, including Zurcher U.S. Pat. No. 4,028,509, make the internal connections with leads bent around a fold connecting the two layers.

SUMMARY OF THE INVENTION

We have discovered that internal electrical connections between spaced-apart contact-carrying layers of a flexible switch can be made with simplified construction and enhanced reliability by adding normally-conductive material to apertures in the spacer layer separating the two layers. No compression is thereby required of the conductive material, eliminating the need for an oversize insert and for rigidity in the contact carrying layers. Where connecting leads are brought out on flexible tails, only one tail is needed.

In a preferred embodiment, unhardened conductive epoxy resin is used, and separate conductive transfer pads are provided on each layer for making electrical contact with the epoxy. The epoxy is applied using pneumatic fluid dispensers, simplifying manufacturing.

RELATION TO OTHER APPLICATIONS

Certain subject matter described herein is disclosed also in copending U.S. patent applications, Ser. No. 845,301, of John A. Mickelson, "Control Panel Overlay", filed Oct. 25, 1977 and Ser. No. 872,115, of Wayne K. Parkinson, "Backlighting Flexible Switch", filed Jan. 25, 1978, the contents of which are incorporated herein by reference.

PREFERRED EMBODIMENT

The structure and operation of the preferred embodiment of the invention are as follows:

STRUCTURE

The drawings show the preferred embodiment, which is then described.

DRAWINGS

FIG. 1 is an exploded isometric view, partially broken away, of said embodiment;

FIG. 2 is a partial sectional view through FIG. 1 at the centerline of the flexible tail (thicknesses are exaggerated for clarity); and FIG. 3 is a partial sectional view through FIG. 1 at the location of one pair of transfer pads joined by a conductive epoxy insert.

DESCRIPTION

Turning to FIG. 1, there is shown flexible switch panel 10 for telephone Touch-Tone (American Telephone and Telegraph Company trademark) switching. Panel 10 consists principally of five adhesively-joined transparent flexible layers: overlay 12, spreader layer 14, upper contact-carrying layer 16, spacer layer 18, and lower contact-carrying layer 20. Flexible tail 22 integral with upper layer 16 is bent downward through slots 24, 26 in spacer layer 18 and lower layer 20. Insert 28 occupies the void left in upper layer 16 by bending tail 22 downward. Below panel 10 an incandescent light source (not shown) provides back-lighting. A frame (not shown) supports panel 10.

Overlay 12, a 10 mil thick flexible non-conductive layer of General Electric Lexan polycarbonate film of grade 8B05 (which includes a velvet texture top surface) and color #112 carries on its undersurface translucent zones of graphic ink 36, 38 and opaque black and gray zones of graphic ink 35 and 40. These are acrylic-based System II inks obtained from KC Coatings, Incorporated Kansas City, Missouri and applied by screening. The layers of ink form black background 35, gray button areas 40, and white translucent indicia 36, 38 including button outlines and centrally-located lettering, numbers, and symbols. Backlighting from an incandescent translucent white light source (not shown) is transmitted through indicia 36, 38.

Spacing overlay 12 from upper layer 16 and adhering to each of the two layers is spreader layer 14, a 3 mil thick transparent Mylar (DuPont trademark) polyethylene terephthalate layer 41 having on both its surfaces thermoset (after it is in place) acrylic transparent pressure-sensitive adhesive layers 42, 44. Each adhesive layer is 1.5 mils thick. A suitable adhesive is the 3M Company's 467 Firm Acrylic Pressure Sensitive Adhesive. Spreader layer 14 is diecut to provide openings 46 (approximately 0.25 inch by 0.30 inch) underneath each button area. All indicia 36, 38 are aligned inside openings 46.

Upper contact-carrying layer 16 (5 mils thick transparent Mylar) has printed on its undersurface three columns of four conductive paint contacts 48 each about 0.4 mils thick. The conductive paint is sold by Acheson Colloids of Port Huron, Mich., under the designation Electrodag 415SS. The contacts 48 are connected by leads 50, which continue onto tail 22. Each contact 48 has the form of a rectangle with a center rectangle removed, thus allowing light transmission through open and therefore transparent center 52. The contacts are approximately 0.55 inch by 0.65 inch and the transparent centers are 0.25 inch by 0.30 inch, equal to the size of spreader openings 46.

Extending from one edge of upper layer 16 is tail 22. Two cuts 54 each about ¼ inch long are made in upper layer 16, and tail 22 is bent downward inside the edge of panel 10. The tail carries leads 50 from contacts 48 on upper layer 16 and leads 56 from transfer pads 58 located adjacent the bend in the tail. Transfer pads 58 are connected to transfer pads 59 and leads 60 on lower layer 20 through hardened conductive epoxy inserts 62 in spacer layer 18. The conductive epoxy comprises an epoxy resin mixed with hardener and having dispersed therein silver particles. The epoxy is supplied by Amicon Corporation, Lexington, Mass., under the trademark Uniset, type C-14. All leads and transfer pads are printed using the same conductive paint as used for contacts 48. In all, tail 22 carries seven leads, one for each column on upper layer 16 and one for each row on lower layer 20. By bending tail 22 down inside the edge of panel 10, leads 50, 56 can be connected to circuitry (not shown) beneath the supporting frame (not shown) and the panel can be sealed to the frame around the panel's entire periphery. Insert 28, made of the same 5 mil, transparent Mylar as upper layer 16, fits into the void between cuts 54.

Spacing upper layer 16 from and adhering it to lower layer 20 is spacer layer 18. Identical in composition to spreader layer 14, spacer layer 18 consists of a 3 mil Mylar layer 64 sandwiched between two 1.5 mil adhesive layers 66, 68. Rectangular spacer holes 70 are die-cut underneath contacts 48. Spacer holes 70 are larger than openings 46 in spreader layer 14, and just slightly smaller than contacts 48 (FIG. 2). Slot 24 receives tail 22. On either side of slot 24 are four round holes 72, which receive unhardened conductive epoxy 62 during assembly for electrically connecting transfer pads 58 and 59. Holes 72 are all ¼ inch in diameter.

Lower contact-carrying layer 20 (5 mils thick transparent Mylar) has printed on its top surface conductive paint contacts 74, leads 60, and transfer pads 59, and carries adhesive layer 73 (3M adhesive described above) on its undersurface. Contacts 74 are connected by an extension of lead 60 to a transfer pad 59. Contacts 74 are registered with contacts 48 on upper layer 16, and have the same rectangular shape with rectangular transparent centers 76. Slot 26 receives tail 22. Adhesive layer 73 adheres entire panel 10 to the supporting frame (not shown).

OPERATION

A person selects the desired button and presses it with his finger generally in the center of the button outline. The force applied by the finger is radially spread in spreader layer 14 to the periphery of the corresponding opening 46 (FIG. 2). The spread out force pattern thus bears directly on rectangular contact ring 48, and assures engagement between contacts 48 and 74. Without the spreader layer, a centrally applied force might not exert enough force at the contact periphery to engage the periphery. When contacts 48 and 74 touch, a circuit is completed between one row lead 60 on lower layer 20 and one column lead 50 and upper layer 16. Layers 16 and 20 thus form an X-Y matrix. The circuit is completed through unhardened conductive epoxy 62 connecting one pair of corresponding transfer pads 58, 59. The incandescent light source illuminates button outlines 36 and the other centrally-located indicia 38 to identify buttons in low light or night conditions. Light is transmitted through adhesive layer 73, transparent center 76 in lower layer 20, spacer hole 70, transparent center 52 in upper layer 16, opening 46 in spreader layer 14, and translucent indicia 36, 38 in overlay 12.

OTHER EMBODIMENTS

Other embodiments of the invention will occur to those skilled in the art. For example, other conductive materials could be substituted for conductive epoxy resin inserts 62, including conductive grease or conductive ink, and hardener could be omitted from the epoxy resin.

OTHER INVENTIONS

Connecting leads from contacts on layers of a flexible switch to other circuitry using a flexible tail bent downward from the switch inside of its edge was the invention of William R. Kissner. The improvement of bending the tail downward from an upper layer through slots in the lower layers was the invention of Wayne K. Parkinson.

Backlighting a flexible touch switch through holes in contact portions carried by transparent layers, with transparent adhesive to bond a transparent layer, and with an apertured layer under a continuous flexible outer layer, for transferring forces to the contact portions, were the inventions of Wayne K. Parkinson.

The use of a spreader layer was the invention of Wayne K. Parkinson.

What is claimed is:

1. A flexible switch having contacts and comprising
- a first flexible layer carrying at least one electrical pathway,
- a second layer carrying at least one electrical pathway,
- means including a spacer layer separating said first and second layers whereby a portion of the first mentioned electrical pathway operates as a movable switching contact, and
- normally conductive material inserted within at least one aperture in said spacer layer and in electrical contact with said electrical pathways on both said first and second layers,
- thereby providing an internal electrical connection between said first and second layers.

2. The flexible switch of claim 1 wherein said conductive material is unhardened conductive epoxy resin.

3. The flexible switch of claim 1 wherein said conductive material is hardened conductive epoxy.

4. The flexible switch of claim 1 wherein said conductive material is conductive grease.

5. The flexible switch of claim 1 wherein said conductive material is conductive ink.

6. The flexible switch of claim 1 wherein said first flexible layer further includes conductive switch pads supported on a first surface, said switch pads being arranged in rows and said switch pads in each row being connected by one of said electrical pathways.

7. A flexible switch of claim 6 wherein said second flexible layer further includes conductive switch pads supported on a surface facing said first surface of said first flexible layer, said switch pads being aligned with said switch pads in said first layer and arranged in columns perpendicular to said rows on said first flexible layer and said switch pads in each column being connected by one of said electrical pathways.

8. The flexible switch of claim 1 or 7 wherein
- said first and second layers further include individual conductive transfer pads connected to said electrical pathways and
- said spacer layer includes a plurality of apertures filled with said conductive material, each said pad on said first layer being aligned with one said aperture and one said pad on said second layer and said aligned pads each being in electrical contact with said conductive material in said aligned aperture, whereby a larger area of contact is formed between said conductive material and said electrical pathways than is required for said electrical pathways.

9. The flexible switch of claim 1 wherein said first flexible layer includes a tail carrying extensions of electrical pathways carried by said first layer, at least one of said extensions being in electrical contact with one of said inserts of conductive material, thereby providing an electrical connection between said second layer and said tail.

* * * * *